US012252371B2

(12) United States Patent
Shoji

(10) Patent No.: US 12,252,371 B2
(45) Date of Patent: Mar. 18, 2025

(54) POST-PROCESSING APPARATUS THAT PERFORMS POST-PROCESSING ON SHEETS DISCHARGED FROM IMAGE FORMING APPARATUS

(71) Applicant: CANON KABUSHIKI KAISHA, Tokyo (JP)

(72) Inventor: Ryuhei Shoji, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 196 days.

(21) Appl. No.: 18/180,266

(22) Filed: Mar. 8, 2023

(65) Prior Publication Data

US 2023/0294953 A1 Sep. 21, 2023

(30) Foreign Application Priority Data

Mar. 15, 2022 (JP) ..... 2022-040735

(51) Int. Cl.
*B65H 9/06* (2006.01)
*B65H 9/00* (2006.01)
*B65H 43/06* (2006.01)

(52) U.S. Cl.
CPC ..... *B65H 43/06* (2013.01); *B65H 9/004* (2013.01); *B65H 9/06* (2013.01); *B65H 2301/4222* (2013.01); *B65H 2515/40* (2013.01); *B65H 2801/27* (2013.01)

(58) Field of Classification Search
CPC ..... B65H 2801/27; B65H 9/004; B65H 9/04; B65H 9/06; B65H 9/10; B65H 9/101; B65H 31/02; B65H 31/34; B65H 31/3081; B65H 31/36; B65H 2301/4222; B65H 2301/4213; B65H 2515/40; B65H 2515/83; B65H 2515/805; B65H 2513/10
USPC ..... 271/184, 285, 286
See application file for complete search history.

(56) References Cited

U.S. PATENT DOCUMENTS

| | | | | |
|---|---|---|---|---|
| 5,303,017 | A | 4/1994 | Smith | |
| 7,703,758 | B2 * | 4/2010 | Kamiya | B65H 31/3027 270/58.1 |
| 7,748,693 | B2 * | 7/2010 | Matsumoto | B65H 3/0607 271/4.03 |
| 8,205,867 | B2 * | 6/2012 | Kamiya | B42C 1/12 270/58.08 |
| 11,353,817 | B2 * | 6/2022 | Agata | B65H 31/26 |

(Continued)

FOREIGN PATENT DOCUMENTS

| | | | |
|---|---|---|---|
| JP | H07-002417 | A | 1/1995 |
| JP | 2002-351281 | A | 12/2002 |

(Continued)

*Primary Examiner* — Leslie A Nicholson, III
(74) *Attorney, Agent, or Firm* — Venable LLP

(57) ABSTRACT

A buffer unit receives a sheet and temporarily holds a predetermined number of sheets so as to be overlaid on one another. A stacking unit stacks the predetermined number of sheets conveyed toward a first direction. A moving unit comes into contact with an uppermost sheet among the predetermined number of sheets stacked on the stacking unit and moves the uppermost sheet further toward the first direction. A regulating unit comes into contact with an end portion of the stack of sheets on the stacking unit to regulate the position of the stack of sheets. A control unit controls the predetermined number of sheets.

19 Claims, 7 Drawing Sheets

(56) References Cited

U.S. PATENT DOCUMENTS

| | | | | |
|---|---|---|---|---|
| 2011/0285072 | A1* | 11/2011 | Yokoya | B65H 39/10 271/227 |
| 2015/0310316 | A1* | 10/2015 | Osada | G06K 15/403 358/1.12 |
| 2017/0183189 | A1 | 6/2017 | Matsuki | |
| 2020/0379397 | A1* | 12/2020 | Agata | G03G 15/6582 |

FOREIGN PATENT DOCUMENTS

| | | | |
|---|---|---|---|
| JP | 2015-117075 | A | 6/2015 |
| JP | 2017-114626 | A | 6/2017 |
| JP | 2017-211599 | A | 11/2017 |
| JP | 2019-018959 | A | 2/2019 |
| JP | 2021-095291 | A | 6/2021 |

* cited by examiner

POST-PROCESSING APPARATUS THAT PERFORMS POST-PROCESSING ON SHEETS DISCHARGED FROM IMAGE FORMING APPARATUS

BACKGROUND OF THE INVENTION

Field of the Invention

The present invention relates to a post-processing apparatus that performs post-processing on sheets discharged from an image forming apparatus.

Description of the Related Art

A post-processing apparatus is an option for an image forming apparatus, and performs post-processing such as binding processing and alignment on sheets on which images have been formed by the image forming apparatus. Japanese Patent Laid-Open No. 2015-117075 discloses a post-processing apparatus in which a sheet is discharged onto a processing tray by discharge rollers, and is then moved using a paddle and a belt and brought into contact with an end regulating member. The paddle and the belt are rotating members that come into contact with the upper surface of the sheet. The paddle and the belt align a sheet stack by moving the sheet in a direction that is substantially opposite the direction in which the sheet is discharged by the discharge rollers.

Japanese Patent Laid-Open No. 2021-095291 discloses a post-processing apparatus in which a buffer mechanism is provided upstream of a post-processing mechanism, and a plurality of sheets are temporarily accumulated in the buffer mechanism while being overlaid on one another. The stack of sheets accumulated in the buffer mechanism is conveyed, while remaining in the state of a sheet stack, to a downstream-side alignment processing unit, where alignment processing is applied to the sheet stack.

However, it is difficult to suppress the occurrence of jams and maintain alignment accuracy during sheet alignment at the same time using a rotating member that comes into contact with only the upper surfaces of sheets, such as a paddle or a belt. If the conveyance force that the rotating member applies to a sheet is too weak, the sheet may not be able to reach an end regulating member, and a sheet alignment failure may occur. On the other hand, if the conveyance force that the rotating member applies to a sheet is too strong, sheet buckling may occur between the rotating member and the end regulating member, and a state in which alignment cannot be performed properly (jammed state) may occur. If a plurality of sheets conveyed in the state of a sheet stack are to be aligned, a greater conveyance force is necessary, and thus it becomes even more difficult to maintain alignment accuracy and suppress jams at the same time.

SUMMARY OF THE INVENTION

The present disclosure teaches a post-processing apparatus comprising: a first conveyance path along which a sheet is conveyed; a buffer unit that receives the sheet conveyed from the first conveyance path and temporarily holds a predetermined number of sheets so as to be overlaid on one another; a second conveyance path along which the predetermined number of sheets from the buffer unit are conveyed when the temporary holding by the buffer unit is terminated; a stacking unit that stacks the predetermined number of sheets conveyed toward a first direction from the second conveyance path; a moving unit that comes into contact with the uppermost sheet among the predetermined number of sheets stacked on the stacking unit and moves the uppermost sheet further toward the first direction; a regulating unit that is provided downstream of the moving unit in the first direction and that comes into contact with an end portion of the stack of sheets on the stacking unit to regulate the position of the stack of sheets, the end portion of the stack of sheets being an end portion on the downstream side in the first direction; and a control unit that controls the predetermined number of sheets, the predetermined number of sheets being the number of sheets that are to be temporarily accumulated in the buffer unit and conveyed to the stacking unit together, wherein the control unit determines the predetermined number of sheets based on one or more physical parameters that affect a frictional force generated on the surface of the sheet.

Further features of the present invention will become apparent from the following description of exemplary embodiments (with reference to the attached drawings).

DESCRIPTION OF THE EMBODIMENTS

Figure 1:
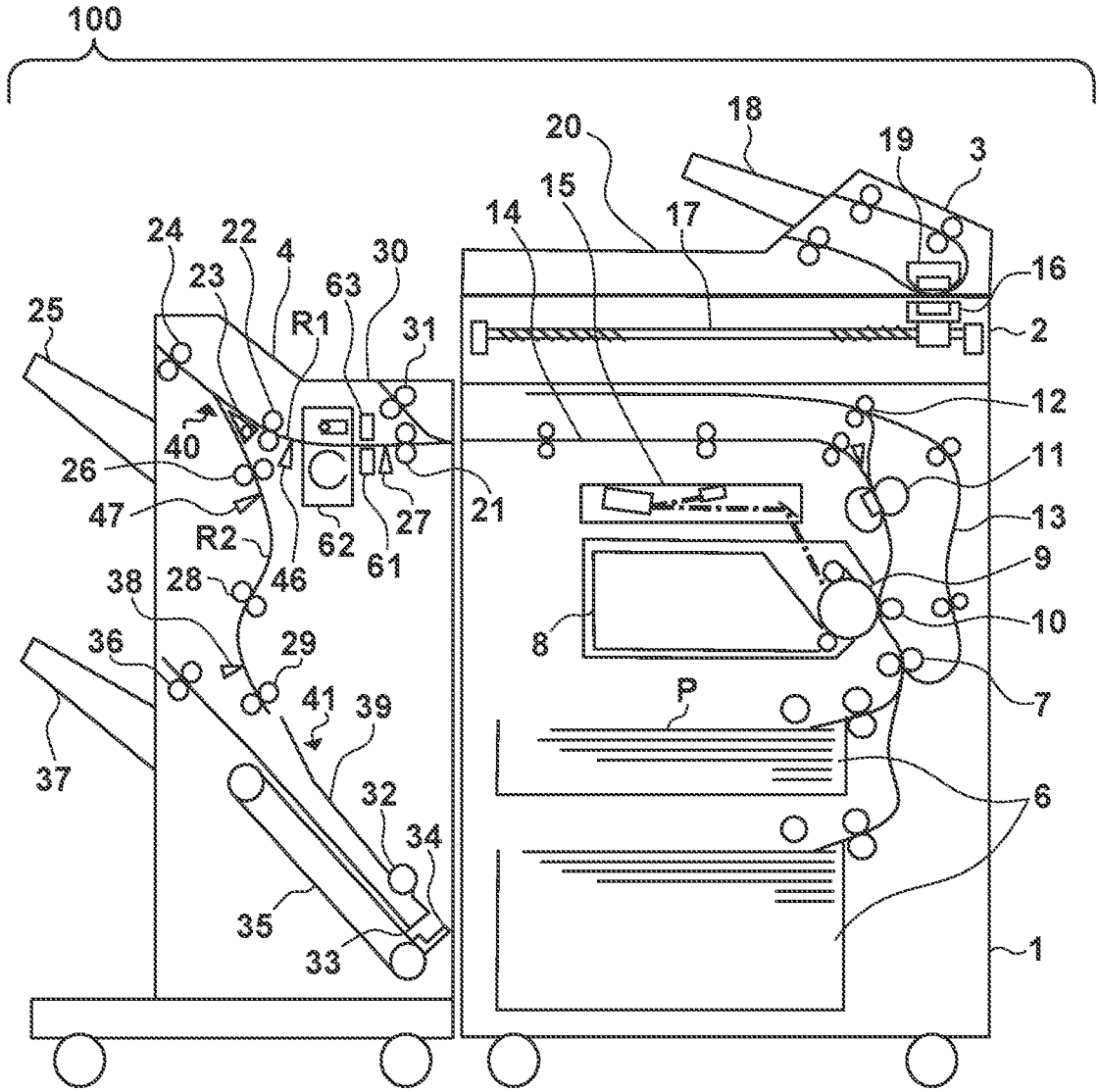
FIG. 1 is a diagram for describing an image forming system.

Hereinafter, embodiments will be described in detail with reference to the attached drawings. Note, the following embodiments are not intended to limit the scope of the claimed invention. Multiple features are described in the embodiments, but limitation is not made to an invention that requires all such features, and multiple such features may be combined as appropriate.

Furthermore, in the attached drawings, the same reference numerals are given to the same or similar configurations, and redundant description thereof is omitted.

Embodiment 1

FIG. 1 illustrates a schematic cross-section of an image forming system 100 including an image forming apparatus 1, an image reading apparatus 2, a document feeding apparatus 3, and a post-processing apparatus 4. The image forming apparatus 1 forms images on sheets P. The image forming method adopted in the image forming apparatus 1 may be any of the electrophotographic method, the inkjet method, the thermal transfer method, or the like, but the electrophotographic method is adopted herein as one example. The image reading apparatus 2 reads documents fed from the document feeding apparatus 3 and creates image data. The post-processing apparatus 4 executes post-processing (e.g., punching, stapling, and/or bookbinding) on sheets P.

The document feeding apparatus 3 conveys a document placed on a document tray 18 to image reading units 16 and 19. The image reading units 16 and 19 can read both sides of the document at once by each reading a document surface facing itself. The document feeding apparatus 3 discharges the document onto a document discharge portion 20.

The image reading apparatus 2 can also read documents that cannot be fed by the document feeding apparatus 3, such as booklet documents, by moving the image reading unit 16 back and forth using a driving device 17. Image data generated by the image reading units 16 and 19 is transmitted to the image forming apparatus 1.

The image forming apparatus 1 includes a plurality of feeding devices 6 each housing a plurality of sheets P. The feeding devices 6 feed sheets one by one at a predetermined feeding interval. A sheet P fed from a feeding device 6 is conveyed to a transfer nip portion by registration rollers 7 after skewing of the sheet P is corrected by the registration rollers 7. The transfer nip portion is formed by a photosensitive drum 9 that is rotatably supported by an image forming cartridge 8, and a transfer roller 10 to which a predetermined transfer voltage is applied. A toner image is formed on the surface of the photosensitive drum 9 through the exposure, charging, latent-image formation, and developing processes being carried out inside the image forming cartridge 8. In particular, a laser scanner unit 15 forms an electrostatic latent image by exposing the uniformly charged surface of the photosensitive drum 9 to laser light. The transfer nip portion transfers the toner image from the photosensitive drum 9 to the sheet P. The sheet P is conveyed to a fixing device 11, and the fixing device 11 fixes the toner image onto the sheet P by applying heat and pressure to the sheet P and the toner image. A horizontal conveyance portion 14 conveys the sheet P having passed through the fixing device 11 and discharges the sheet P to the post-processing apparatus 4. When both-side printing is to be executed, the sheet P is conveyed to reversing rollers 12, and the reversing rollers 12 execute switchback conveyance for reversing the front and rear ends of the sheet P. Thus, the sheet P is sent to a re-feeding portion 13. The re-feeding portion 13 conveys the sheet P to the registration rollers 7 again. Then, an image is formed on the sheet P again.

The post-processing apparatus 4 includes a buffer portion 40 and a stage portion 41. The buffer portion 40 forms a sheet stack by overlaying a plurality of sheets P on one another while shifting the sheets P relative to one another in the conveyance direction, and temporarily holds the sheet stack. The buffer portion 40 may temporarily hold only one sheet P. The stage portion 41 accumulates a predetermined number of sheets P, and performs alignment processing and binding processing on the sheets P.

The post-processing apparatus 4 discharges a sheet P conveyed thereto from the horizontal conveyance portion 14 to either a front tray 30, an upper tray 25, or a lower tray 37. Sheets P received by the stage portion 41 are subjected to binding processing and become a sheet stack. The sheet stack is discharged onto the lower tray 37. A sheet stack may be discharged onto the lower tray 37 without being subjected to binding processing.

A sheet P conveyed from the horizontal conveyance portion 14 is transferred to either discharge rollers 31 or entrance rollers 21 of the post-processing apparatus 4 by an unillustrated conveyance-path-switching flapper. A sheet P transferred to the discharge rollers 31 is directly discharged onto the front tray 30. A sheet P transferred to the entrance rollers 21 is conveyed further along a first conveyance path R1 inside the post-processing apparatus 4.

An entrance sensor 27 is provided downstream of the entrance rollers 21 in the conveyance direction of the sheet P. The entrance sensor 27 is a sheet sensor that senses the passing of the front and rear ends of the sheet P received by the entrance rollers 21 and senses whether or not a jam has occurred.

A line sensor 61, an illumination unit 63, and a rotary punching unit 62 are disposed downstream of the entrance sensor 27. The line sensor 61 and the illumination unit 63 detect an end portion of the sheet P. The punching unit 62 is connected to a punching motor, a motor for adjusting end-portion position, a punch position sensor, and a home position sensor, all of which are unillustrated. The punching motor drives a punch and a die. The motor for adjusting end-portion position adjusts the position of the end portion of the sheet P relative to the punching unit 62 by driving the punching unit 62 in the width direction of the sheet P. The width direction is a direction that is orthogonal to the conveyance direction of the sheet P. In such a manner, the line sensor 61, the illumination unit 63, and the punching unit 62 are used to punch holes in sheets. An instruction as to whether holes are to be punched or not is provided via an external device or an unillustrated touch panel attached to the image forming apparatus 1, the image reading apparatus 2, the document feeding apparatus 3, or the like.

Pre-buffering rollers 22 accelerate the sheet P at a predetermined timing based on the passing time of the rear end of the sheet P as sensed by the entrance sensor 27. The predetermined timing is when the punching of the final hole in the sheet P is completed in a case in which punching is performed, and is when the rear end of the sheet P passes the entrance sensor 27 in a case in which punching is not performed. If the discharge destination of the sheet P is the upper tray 25, the sheet P is decelerated to a predetermined discharge speed when the rear end of the sheet P has arrived between the pre-buffering rollers 22 and reversing rollers 24, and is then discharged onto the upper tray 25.

If the discharge destination of the sheet P is the lower tray 37, the sheet P is sent into a second conveyance path R2 from the first conveyance path R1. A sheet sensor 46 provided on the first conveyance path R1 senses the timing when the rear end of the sheet P passes a backflow suppression flap 23. The sheet P temporarily stops at the timing when the rear end of the sheet P has passed the backflow suppression flap 23. The backflow suppression flap 23 is biased in the clockwise direction by an unillustrated spring. Subsequently, the reversing rollers 24 switch back the sheet P and convey the sheet P to internal discharge rollers 26.

A sheet sensor 47 senses that the front end of the sheet P has arrived at the internal discharge rollers 26. At this point, the reversing rollers 24 release the nip therebetween, and prepare to receive a subsequent sheet P traveling toward the reversing rollers 24. The internal discharge rollers 26 temporarily stop in a state in which the sheet P is sandwiched therebetween. Once the arrival of a subsequent sheet P is detected by the sheet sensor 46, the internal discharge rollers 26 reverse and the sheet P is conveyed toward the reversing rollers 24 again. In such a manner, the buffer portion 40 buffers a plurality of sheets P by overlaying a preceding sheet and a subsequent sheet on one another. The buffer portion 40 can buffer a plurality of sheets P regardless of the lengths of the sheets P by repeatedly switching back the sheets P using the internal discharge rollers 26. The operation for buffering (overlaying) sheets P will be described in detail later.

A sheet P conveyed from the internal discharge rollers 26 is conveyed to an intermediate stacking portion 39 via intermediate conveyance rollers 28 and 29. A sheet sensor 38 is provided between the intermediate conveyance rollers 28 and 29. A longitudinal alignment reference plate 33 is disposed in the most downstream portion of the intermediate stacking portion 39. A sheet stack is aligned by an end portion of the sheet P coming into contact with the longitudinal alignment reference plate 33. Here, a longitudinal alignment roller 32 assists the alignment of the sheet P by slightly rotating so that the sheet P comes into contact with the longitudinal alignment reference plate 33. After the sheet P reaches the longitudinal alignment reference plate 33, the sheet stack is aligned in the lateral direction by an unillustrated lateral alignment jogger performing an alignment operation relative to an unillustrated lateral alignment reference plate.

Upon completion of the alignment of a sheet stack including a predetermined number of sheets P, a stapler of the stage portion 41 executes a binding operation on the sheet stack. Subsequently, the sheet stack is pushed out toward stack discharge rollers 36 from the intermediate stacking portion 39 as a result of a stack discharge guide 34 that is connected to a guide driving portion 35 moving.

At the point when the front end of the sheet stack has reached the stack discharge rollers 36, the guide driving portion 35 stops the stack discharge guide 34 and returns the stack discharge guide 34 to a standby position. The stack discharge rollers 36 discharge the sheet stack received from the stack discharge guide 34 onto the lower tray 37.

Buffer Operation

FIGS. 2A to 2F illustrate the buffer operation of the buffer portion 40 in detail. The buffer operation is an operation for causing the predetermined number of sheets P forming a subsequent sheet stack to wait in the buffer portion 40 until binding processing of a preceding sheet stack is completed in the stage portion 41. By performing the buffer operation, the image forming system 100 can execute an image forming job including binding processing without decreasing the productivity (number of images output per unit time) of the image forming apparatus 1.

In FIGS. 2A to 2F, in order to distinguish a plurality of sheets P from one another, a "sheet P1", a "sheet P2", and a "sheet P3" are defined in the order in which the sheets P are transferred from the image forming apparatus 1 to the post-processing apparatus 4. Specifically, the smaller the numerical value appended to P, the earlier the arrival at the post-processing apparatus 4. The arrows indicate the conveyance directions of the sheets P. Note that, among two ends of a sheet P with respect to the conveyance direction of the sheet P, the end that passes the entrance rollers 21 earlier is defined as a "first end", and the end that passes the entrance rollers 21 later is defined as a "second end".

Figure 2A:
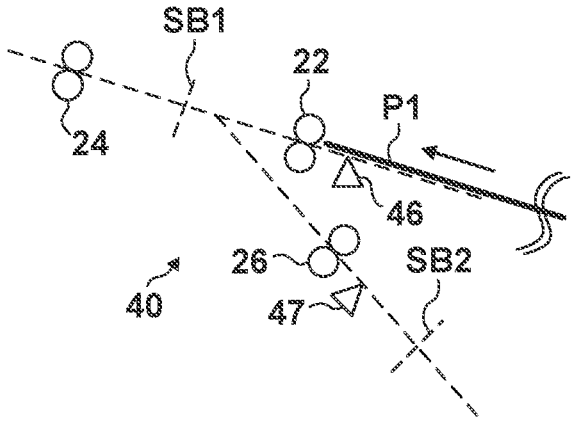
FIGS. 2A to 2F are diagrams for describing an operation for overlaying sheets on one another.

FIG. 2A illustrates a state at the point when the front end (first end) of the sheet P1 has passed the position of the sheet sensor 46. Subsequently, the sheet P1 is conveyed toward the reversing rollers 24.

Figure 2B:
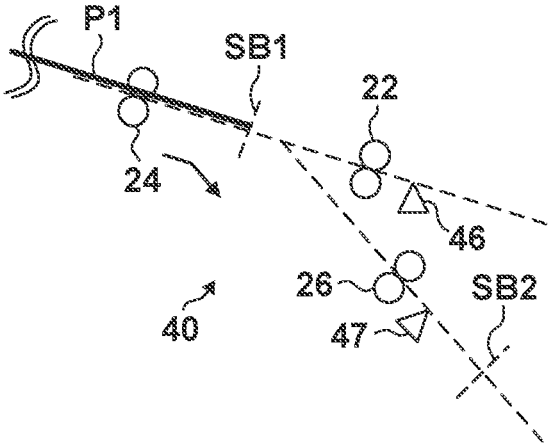

FIG. 2B illustrates a state at the point when the rear end (second end) of the sheet P1 conveyed by the pre-buffering rollers 22 has reached a reversing position SB1. Subsequently, the rotation direction of the reversing rollers 24 changes from forward to reverse, and the conveyance direction of the sheet P1 is reversed (switched back). Thus, the sheet P1 is conveyed toward the internal discharge rollers 26. The reversing rollers 24 stop when the sheet sensor 47 senses that the rear end (second end) of the sheet P1 has reached the position of a reversing position SB2. Note that the sheet P1 is regulated by the sheet backflow suppression flap 23 so that the sheet P1 does not travel toward the pre-buffering rollers 22.

Figure 2C:
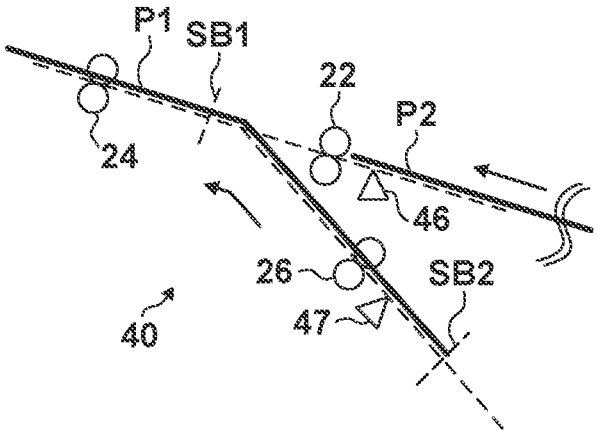

FIG. 2C illustrates a state at the point when the rear end (second end) of the sheet P1 is positioned at the reversing position SB2, and the front end (first end) of the sheet P2 has passed the sheet sensor 46. Subsequently, the sheet P2 is conveyed toward the reversing rollers 24 by the pre-buffering rollers 22, similarly to the sheet P1 described in FIG. 2A. The internal discharge rollers 26 start to rotate in reverse in order to overlay the sheet P1 and the sheet P2 on one another. Thus, the sheet P1 is conveyed toward the reversing rollers 24. The reversing timing of the internal discharge rollers 26 is adjusted so that the sheet P1 and the sheet P2 are overlaid on one another so as to be shifted from one another by a predetermined shift amount with respect to the conveyance direction. Specifically, the second end of the sheet P1 and the second end of the sheet P2 are shifted from one another, and the second end of the sheet P2 comes closer to the reversing rollers 24 than the second end of the sheet P1 does.

Figure 2D:
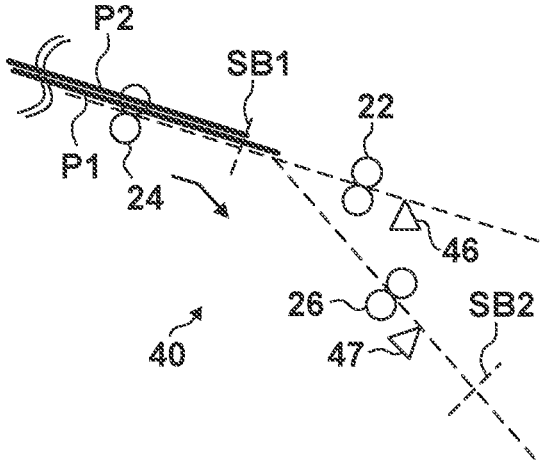

FIG. 2D illustrates a state at the point when the rear end (second end) of the sheet P2 has reached the reversing position SB1. As illustrated in FIG. 2D, a state (i.e., a sheet stack) is established in which the sheet P1 is positioned on the lower-surface side of the sheet P2. Subsequently, the reversing rollers 24 start to rotate in reverse so that the stack of sheets P1 and P2 is conveyed to the stage portion 41 as a sheet stack. Thus, the stack of sheets P1 and P2 is conveyed toward the internal discharge rollers 26. Note that, when the reversing rollers 24 start to rotate in reverse, the internal discharge rollers 26 start to rotate forward.

Figure 2E:
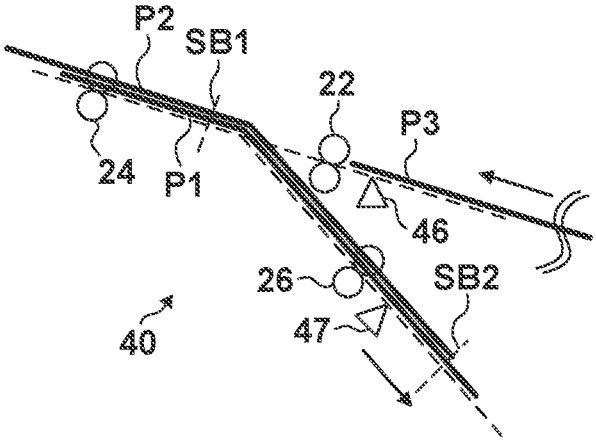

FIG. 2E illustrates a state when the rear end (second end) of the stack of sheets P1 and P2 is positioned at the reversing position SB2. Note that the rear end (second end) of the sheet P1 is positioned downstream of the reversing position SB2, and the rear end (second end) of the sheet P2 is positioned at the reversing position SB2. FIG. 2E also illustrates a state at the point when the front end (first end) of the sheet P3 has passed the position of the sheet sensor 46. The sheet P3 is conveyed toward the reversing rollers 24 by the pre-buffering rollers 22, similarly to the sheet P1 and the sheet P2 respectively described in FIGS. 2A and 2C. On the other hand, the stack of sheets P1 and P2 is conveyed toward the stage portion 41, unlike the sheet P1 described in FIG. 2C.

Figure 2F:
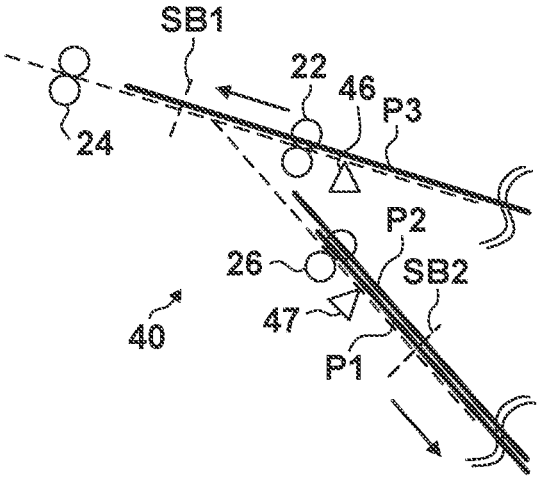

FIG. 2F illustrates a state in which the stack of sheets P1 and P2 is conveyed to the stage portion 41 and the sheet P3 is conveyed toward the reversing rollers 24. The sheet P3 subsequently advances until the rear end (second end) thereof reaches the reversing position SB1, similarly to the sheet P1 in FIG. 2B.

In such a manner, in embodiment 1, a plurality of sheets P conveyed from the image forming apparatus 1 form a sheet stack in the buffer portion 40. Note that, while the number M of sheets P overlaid on one another is two in FIGS. 2A to 2F, this is merely one example. The buffer portion 40 is also capable of buffering three or more sheets P. In this case, in FIG. 2E, the stack of sheets P1 and P2 sandwiched between the internal discharge rollers 26 is conveyed toward the reversing rollers 24 by the internal discharge rollers 26 as illustrated in FIG. 2C. Thus, overlaying on the subsequent sheet P3 is executed. Three or more sheets P can be buffered by this overlaying being repeated.

Alignment Operation

FIGS. 3A to 3E illustrate an operation performed in the stage portion 41 for aligning a sheet stack with respect to the conveyance direction. Here, an example will be described in which, in a state in which an aligned stack of sheets P1 and P2 is present in the stage portion 41, another stack of sheets P3 to P5 formed from three sheets P is conveyed from the buffer portion 40 to the stage portion 41.

Figure 3A:
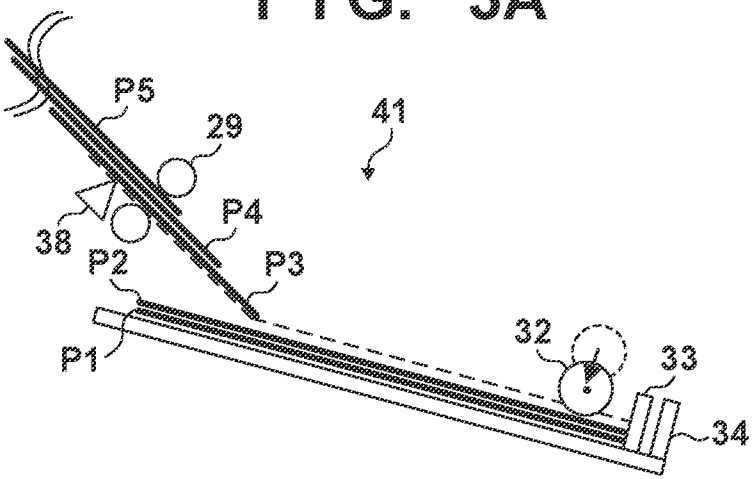
FIGS. 3A to 3E are diagrams for describing an alignment operation.

FIG. 3A illustrates a state in which the rear end (second end) of the stack of sheets P3 to P5, which is formed from three sheets P3, P4, and P5, has reached the sheet sensor 38 and has advanced further into the stage portion 41. The longitudinal alignment roller 32 of the stage portion 41 moves down (arrow in the drawing) from a standby position toward the stage portion 41 having the sheets P1 and P2 stacked thereon in order to perform alignment processing on the stack of sheets P3 to P5. The longitudinal alignment roller 32 may come into contact with the sheet P2. Subsequently, the longitudinal alignment roller 32 starts to rotate before the stack of sheets P3 to P5 reaches the longitudinal alignment roller 32.

Figure 3B:
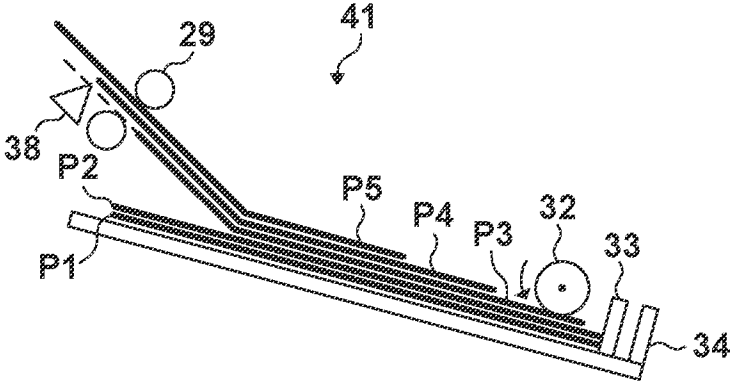

FIG. 3B illustrates a state in which the sheet P3 in the stack of the three sheets P3 to P5 has reached the longitudinal alignment roller 32. As a result of the longitudinal alignment roller 32 rotating in the counterclockwise direction, an end portion of the sheet P3 comes into contact with the longitudinal alignment reference plate 33. Thus, the end portion of the sheet P3 is aligned with end portions of the sheets P1 and P2 (alignment processing).

Figure 3C:
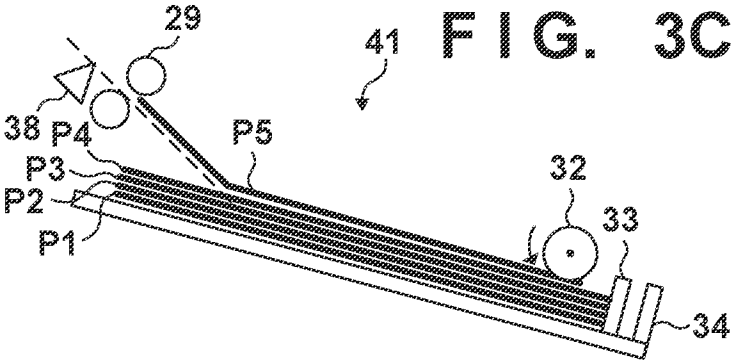

FIG. 3C illustrates a state in which the alignment of the sheets P3 and P4 in the stack of the three sheets P3 to P5 has been completed, and the sheet P5 on the uppermost surface has reached the longitudinal alignment roller 32. As a result of the longitudinal alignment roller 32 continuing to rotate in the counterclockwise direction, an end portion of the sheet P5 comes into contact with the longitudinal alignment reference plate 33. Thus, the end portion of the sheet P5 is aligned with the end portions of the sheets P1 to P4.

Figure 3D:
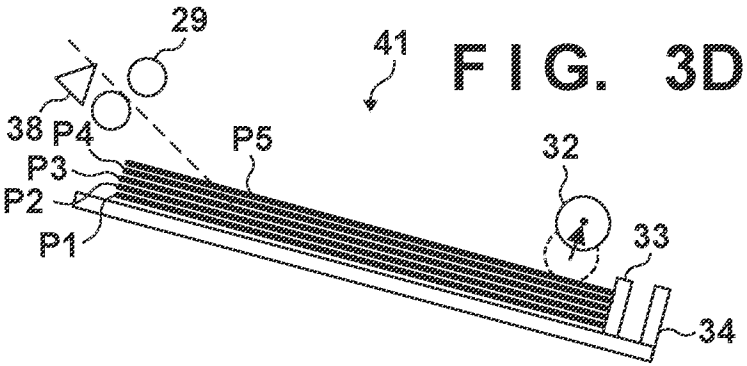

FIG. 3D illustrates a state in which the alignment processing of the stack of sheets P3 to P5 has been completed. At this time, the longitudinal alignment roller 32 moves away from the stage portion 41 so as not to interfere with the discharge of the stack of sheets P1 to P5.

Figure 3E:
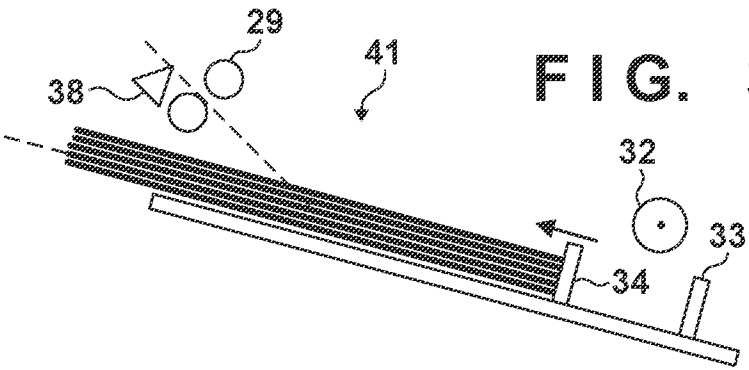

FIG. 3E illustrates a state in which the aligned stack of sheets P1 to P5 is pushed out toward the outlet by the stack discharge guide 34. When the aligned stack has been pushed out, the stack discharge guide 34 returns to the standby position in order to receive subsequent sheets P to be conveyed from the buffer portion 40. Note that a stapling unit of the stage portion 41 may perform stapling processing between the timing illustrated in FIG. 3D and the timing illustrated in FIG. 3E.

Relationship between Alignment Conveyance Force and Frictional Force

Next, the relationship between a frictional force and an alignment conveyance force involved in the operation for aligning a sheet/sheet stack will be described with reference to FIGS. 3B and 3C.

Alignment of Single Sheet P

First, a conveyance force of the longitudinal alignment roller 32 when a single sheet P is aligned and a frictional force interfering with the operation for aligning the sheet P will be described with reference to FIG. 3C. Here, a case is considered in which only the sheet P5 is individually conveyed from the buffer portion 40, and the sheets P1 to P4 have already been conveyed from the buffer portion 40 and have already been aligned.

The sheet P5 in contact with the rotating longitudinal alignment roller 32 receives, from the longitudinal alignment roller 32, a conveyance force Ffeed for advancing toward the longitudinal alignment reference plate 33. On the other hand, the sheet P5 is conveyed while coming into contact with the sheet P4. Accordingly, the sheet P5 receives, as a force interfering with the alignment operation, a frictional force Ffric_bottom associated with the contact with the sheet P4.

If the conveyance force Ffeed exceeds the frictional force Ffric_bottom, the sheet P5 advances until the end portion of the sheet P5 comes into contact with the longitudinal alignment reference plate 33. Once the end portion of the sheet P5 comes into contact with the longitudinal alignment reference plate 33, a frictional force Fedge acts between the sheet P5 and the longitudinal alignment roller 32. Accordingly, the frictional force acting on the sheet P5 increases. Thus, the sheet P5 stops advancing because the magnitude relationship between the conveyance force Ffeed and the frictional force Ffric_bottom+Fedge is reversed.

If the conveyance force Ffeed falls below the frictional force Ffric_bottom, the sheet P5 cannot advance toward the longitudinal alignment reference plate 33. Thus, the end portion of the sheet P5 cannot reach the longitudinal alignment reference plate 33, and an alignment failure of the sheet P5 occurs.

An alignment failure may also occur if the conveyance force Ffeed is too high. If the conveyance force Ffeed exceeds the frictional force Ffric_bottom+Fedge, the sheet P5 is pushed further toward the longitudinal alignment reference plate 33 even after the end portion of the sheet P5 comes into contact with the longitudinal alignment reference plate 33. Due to this, buckling of the sheet P5 occurs between the longitudinal alignment roller 32 and the longitudinal alignment reference plate 33, and a jam thus occurs. Even if buckling of the sheet P5 does not occur, the sheet P5 may be bent between the longitudinal alignment roller 32 and the longitudinal alignment reference plate 33. When the longitudinal alignment roller 32 moves away as illustrated in FIG. 3D, the sheet P5 advances toward the front end (first end) direction such that the bending of the sheet P5 is corrected. At this time, the end portion of the sheet P5 that was in contact with the longitudinal alignment reference plate 33 may also move toward the front end (first end) direction, and an alignment failure may thus occur.

Thus, the conveyance force Ffeed applied by the longitudinal alignment roller 32 needs to be a very weak conveyance force that would not cause buckling or bending of sheets P. The relationship between the conveyance force and the frictional force is adjusted so that Formula (1) is satisfied. Due to this, the accuracy of the alignment by the longitudinal alignment roller 32 is improved.

$$\text{Ffric_bottom} < \text{Ffeed} < (\text{Ffric_bottom} + \text{Fedge}) \quad (1)$$

The frictional force Ffric_bottom acting between a plurality of sheets P largely depends on the state of the sheets P. For example, the frictional force Ffric_bottom increases if the area of contact between two sheets P is large, and if the smoothness of the sheets P is high. In particular, the adhesion between a plurality of sheets P that are overlaid on one another increases if images occupy a large area of the surface area of the sheets P, and if the sheets P remain at high temperature. Thus, the frictional force also increases considerably in such cases. In the case in which a single sheet P5 is conveyed to the stage portion 41, the temperature of the sheet P5 readily decreases because heat is dissipated during conveyance. Furthermore, the sheet P4 affected by friction during the alignment and the alignment-target sheet P5 are not pressed into contact with one another until the alignment is complete. Thus, the increase in frictional force is negligible.

Alignment of Sheet Stack

Next, a conveyance force of the longitudinal alignment roller 32 when a sheet stack is aligned and a frictional force interfering with the alignment operation will be described with reference to FIG. 3B. The sheet P3 in contact with the rotating longitudinal alignment roller 32 receives, from the longitudinal alignment roller 32, a conveyance force Ffeed toward the longitudinal alignment reference plate 33. On the other hand, the sheet P3 receives, as a force interfering with the alignment operation, a frictional force Ffric_bottom from the sheet P2.

If the conveyance force Ffeed exceeds the frictional force Ffric_bottom, the sheet P3 advances until the end portion of the sheet P3 comes into contact with the longitudinal alignment reference plate 33. Once the end portion of the sheet P3 comes into contact with the longitudinal alignment reference plate 33, the frictional force increases due to a frictional force Fedge acting between the sheet P3 and the longitudinal alignment roller 32. Thus, the sheet P3 stops advancing because the magnitude relationship between the conveyance force Ffeed and the frictional force Ffric_bottom+Fedge is reversed.

If the conveyance force Ffeed falls below the frictional force Ffric_bottom, the sheet P3 cannot advance toward the longitudinal alignment reference plate 33. Thus, the end portion of the sheet P3 cannot reach the longitudinal alignment reference plate 33. Due to this, an alignment failure of the sheet P3 occurs. An alignment failure may also occur if the conveyance force Ffeed is too high. If the conveyance force Ffeed exceeds the frictional force Ffric_bottom+Fedge, the sheet P3 is pushed further toward the longitudinal alignment reference plate 33 even after the end portion of the sheet P3 comes into contact with the longitudinal alignment reference plate 33. Due to this, buckling of the sheet P3 occurs between the longitudinal alignment roller 32 and the longitudinal alignment reference plate 33, and a jam thus occurs. Even if buckling of the sheet P3 does not occur, the sheet P3 may be bent between the longitudinal alignment roller 32 and the longitudinal alignment reference plate 33. When the longitudinal alignment roller 32 moves away, the sheet P3 advances toward the front end (first end) direction of the sheet P3 such that the bending of the sheet P3 is corrected. The rear end (second end) of the sheet P3 that was in contact with the longitudinal alignment reference plate 33 also moves toward the front end (first end) direction. Due to this, an alignment failure occurs.

The frictional force Ffric_bottom acting between the sheets P3 and P2 largely depends on the state of the sheets P3 and P2. For example, the frictional force Ffric_bottom increases if the area of contact between sheets P3 and P2 is large, and if the smoothness of the sheets P3 and P2 is high. The adhesion between a plurality of sheets P increases if images occupy a large area of the surface area of the sheets P, and if the sheets P remain at high temperature. Thus, the frictional force increases considerably in such cases. In the case in which sheets are conveyed as a sheet stack to the stage portion 41, the sheet stack is formed in the buffer portion 40. Due to a plurality of sheets being overlaid on one another, heat cannot be readily dissipated from the sheet stack. Accordingly, the temperature of the sheet stack does not readily decrease during conveyance. The sheets in the sheet stack are conveyed toward the stage portion 41 while being pressed into contact with one another. Thus, a high frictional force is present between the sheets P3 and P4, which need to be separated from one another upon alignment.

In such a manner, there are cases in which Formula (1) is not satisfied in the case of a sheet stack as well. In other words, situations in which a sheet stack cannot be conveyed to the stage portion 41 are prone to occur.

Upon receiving a print request necessitating conveyance to the stage portion 41, the post-processing apparatus 4 determines, based on sheet information, whether or not a sheet stack is to be formed in the buffer portion 40. Specifically, in a case in which an alignment failure would occur if a sheet stack were conveyed to the stage portion 41, the formation of a sheet stack is inhibited. Accordingly, sheets P are conveyed to the stage portion 41 one by one.

Control System

Figure 4:
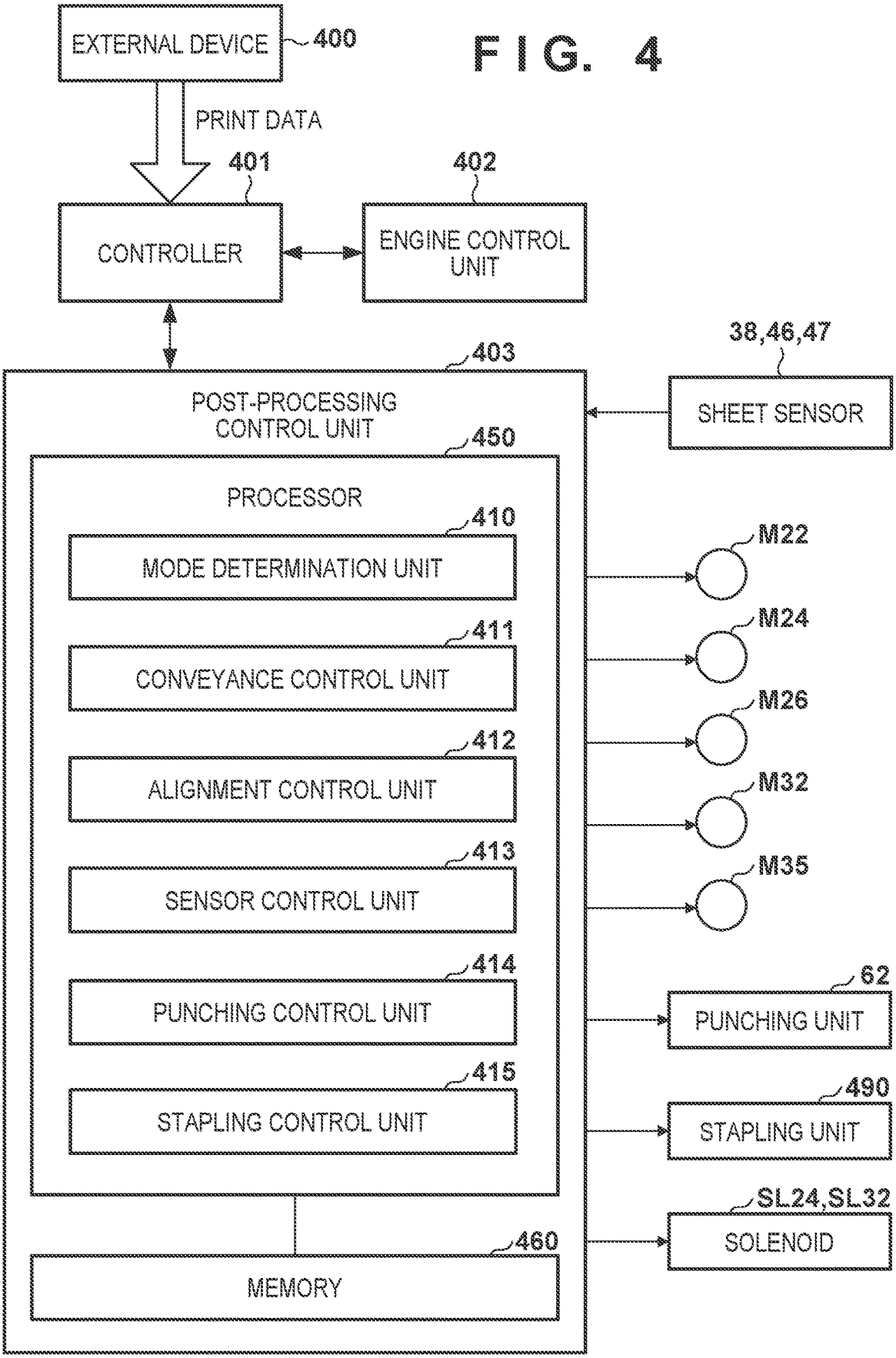
FIG. 4 is a block diagram for describing a control system.

FIG. 4 illustrates a control system in the image forming system 100. An external device 400 is a computer that supplies print data to a controller 401. The controller 401 is a control board that integrally controls the entire image forming system 100. An engine control unit 402 controls image forming in the image forming apparatus 1. A post-processing control unit 403 integrally controls the components of the post-processing apparatus 4. The post-processing control unit 403 includes a processor 450 (e.g., a CPU or the like) and a memory 460 (e.g., a ROM and a RAM). The processor 450 realizes various functions by executing a control program stored in the memory 460.

A mode determination unit 410 determines the number M of sheets in a sheet stack to be formed in the buffer portion 40 based on one or more physical parameters affecting the frictional force generated on the surface of sheets P. M is an integer of 1 or more. Note that, when M equals 1, a plurality of sheets P are not overlaid on one another. The conveyance mode when M equals 1 may be referred to as a "single conveyance mode". The conveyance mode when M is 2 or more may be referred to as a "stack conveyance mode". Thus, determining the number M of sheets in a sheet stack is substantially equivalent to determining the conveyance mode.

The mode determination unit 410 determines the conveyance mode (number M of sheets) based on print reservation information input from the controller 401. The print reservation information indicates the outlet, the type of post-processing, the type of sheets P, the size of the sheets P, the conveyance speed, the fixing temperature, etc. A determination table indicating the conveyance mode or the number M of sheets associated with the print reservation information may be stored in the memory 460. Alternatively, Formula (1) may be stored in the memory 460.

A conveyance control unit 411 controls the conveyance of sheets P by controlling motors M22, M24, M26, and M35. Note that there is an unillustrated driving circuit that is called a motor driver between the conveyance control unit 411 and the motors M22, M24, M26, and M35. The motor M22 is a motor that drives the pre-buffering rollers 22 to rotate. The motor M24 is a motor that drives the reversing rollers 24 to rotate. The motor M26 is a motor that drives the internal discharge rollers 26 to rotate. The motor M35 is a motor that drives the guide driving portion 35. An alignment control unit 412 controls a motor M32. The motor M32 is a motor that drives the longitudinal alignment roller 32 to rotate. A sensor control unit 413 supplies power to the entrance sensor 27 and to the sheet sensors 38, 46, and 47, and acquires sensing results. A punching control unit 414 controls the punching unit 62. A stapling control unit 415 controls a stapling unit 490.

A solenoid SL24 is a solenoid that switches the reversing rollers 24 between a nipping state and a release state. A solenoid SL32 is a solenoid that moves the longitudinal alignment roller 32 up and down.

Flowchart

Figure 5:
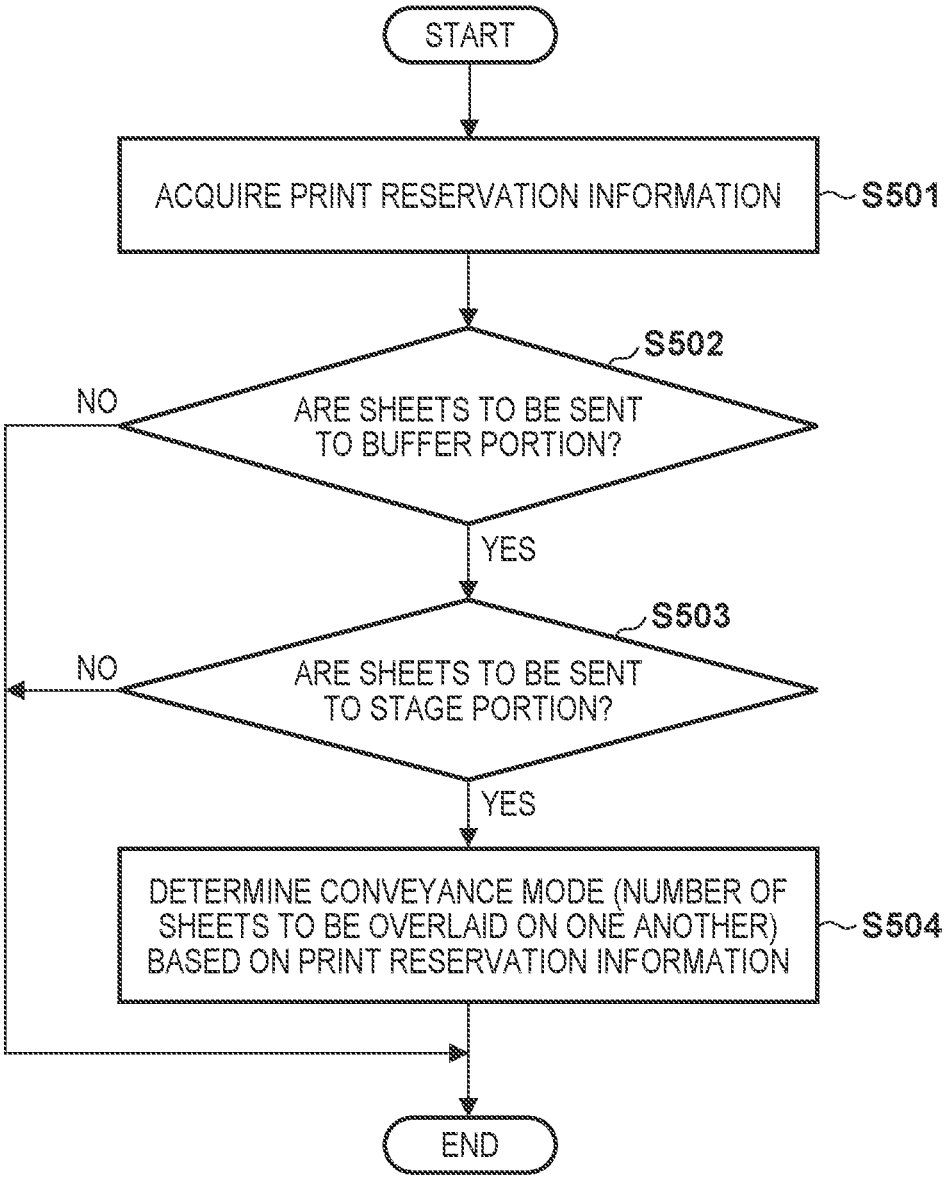
FIG. 5 is a flowchart illustrating a control method.

FIG. 5 illustrates a control method that the processor 450 executes in accordance with the control program.

In step S501, the processor 450 (mode determination unit 410) acquires print reservation information from the controller 401.

In step S502, the processor 450 (mode determination unit 410) determines whether or not sheets P are sheets to be sent to the buffer portion 40 based on the outlet information included in the print reservation information. If the sheets P are not sheets to be sent to the buffer portion 40, the processor 450 skips steps S503 and S504. If the sheets P are sheets to be sent to the buffer portion 40, the processor 450 proceeds to step S503.

In step S503, the processor 450 (mode determination unit 410) determines whether or not the sheets P are sheets to be sent to the stage portion 41 based on the outlet information included in the print reservation information. If the sheets P are sheets that are not to be conveyed to the stage portion 41, the mode determination unit 410 determines that the operation for overlaying the sheets P on one another can be performed, and terminates the sequence of determination processing. Note that the mode determination unit 410 notifies the conveyance control unit 411 that the sheets P are sheets that are not to be conveyed to the stage portion 41. On the other hand, if the sheets P are sheets to be conveyed to the stage portion 41, the processor 450 proceeds to step S504.

In step S504, the processor 450 (mode determination unit 410) determines the conveyance mode (the number M of sheets to be overlaid on one another) based on the print reservation information. For example, if the information about the type of the sheets P included in the print reservation information indicates gloss paper, the mode determination unit 410 determines that the overlaying of the sheets P on one another is not to be executed. In other words, the number M of sheets to be overlaid on one another is determined as 1. If the sheets P are sheets of gloss paper, a condition (Ffric_bottom≥Ffeed) under which sheet stack alignment cannot be executed properly is satisfied. Thus, the mode determination unit 410 determines that the overlaying of the sheets P on one another is not to be executed. The mode determination unit 410 notifies the conveyance control unit 411 that the overlaying of the sheets P on one another is not to be executed. On the other hand, if the information about the type of the sheets P satisfies a condition (Ffric_bottom<Ffeed) under which sheet stack alignment can be executed properly, the mode determination unit 410 determines that the sheets P can be overlaid on one another. The mode determination unit 410 notifies the conveyance control unit 411 with an instruction to execute the overlaying of the sheets P on one another. Note that, once the number M of sheets to be overlaid on one another is determined, the mode determination unit 410 notifies the conveyance control unit 411 of the number M of sheets to be overlaid on one another.

In such a manner, the number M of sheets to be overlaid on one another is determined based on a parameter that affects the frictional force of sheets P. For example, it is determined whether or not sheets P are to be overlaid on one another. Thus, overlaying is skipped for sheets P for which alignment accuracy is low. In other words, overlaying is executed for sheets P for which alignment accuracy is high. Thus, sheet stack alignment accuracy can be maintained and jams can be suppressed at the same time.

In embodiment 1, the determination of whether or not overlaying is to be performed in the buffer portion 40 is made in accordance with the information about sheet type (gloss paper or not) included in the print reservation information. However, this is merely one example. For example, a condition for determining that overlaying cannot be performed may be added for sheet types other than gloss paper. Furthermore, a configuration can also be adopted such that, given that Formula (1) is satisfied, a determination that overlaying can be performed is made even for gloss paper. Also, for example, the number M of sheets to be overlaid on one another may be determined based on one or more of the size of sheets P, information about images formed on the sheets P (image formation ratio or area of image formation regions), and the image formation surface(s) (one side or both sides) of the sheets P, besides the type of the sheets P. For example, arithmetic formulas for acquiring Ffric_bottom, Ffeed, and Fedge from such parameters may be stored in the ROM of the memory 460. The processor 450 acquires Ffric_bottom, Ffeed, and Fedge by substituting one or more parameters acquired from the print reservation information into the arithmetic formulas. Furthermore, the processor 450 determines whether or not Ffric_bottom, Ffeed, and Fedge satisfy Formula (1).

While the condition for determining whether or not overlaying is to be performed is determined in advance in embodiment 1, the determination condition may be changed dynamically. For example, the processor 450 may acquire jam occurrence ratios for individual sheet types based on sensing results of the entrance sensor 27 and the sheet sensor 38, 46, and 47, and hold the acquired jam occurrence ratios in the memory 460. Furthermore, the processor 450 may also hold, in the memory 460, information regarding the occurrence of alignment failures caused by sheet stacks being conveyed. Accordingly, the processor 450 may reduce the number M of sheets P to be overlaid on one another for sheets P of types for which the jam occurrence ratio is high or for sheets P of types for which the alignment failure occurrence ratio is high. For example, the number M of sheets to be overlaid on one another may be reduced from 2 to 1 or from 3 to 2. Such addition of conditions may be performed autonomously by the post-processing apparatus 4, or may be performed based on user instructions.

As described above, in accordance with one or more parameters relating to sheets P conveyed to the post-processing apparatus 4, it is determined whether the sheets P are to be conveyed to the stage portion 41 individually or as a sheet stack. Thus, it is expected that alignment accuracy in the stage portion 41 will be maintained and jams will be less likely to occur as well.

Embodiment 2

Embodiment 2 differs from embodiment 1 in that environment information is taken into consideration as a condition for determining whether or not overlaying is to be performed. Examples of environment information include the ambient temperature and the ambient humidity of the environment in which the image forming system 100 or sheets P is/are placed, etc. Such pieces of environment information are also parameters affecting the frictional force of sheets P, and thus are taken into consideration upon determining the number M of sheets to be overlaid on one another.

Figure 6:
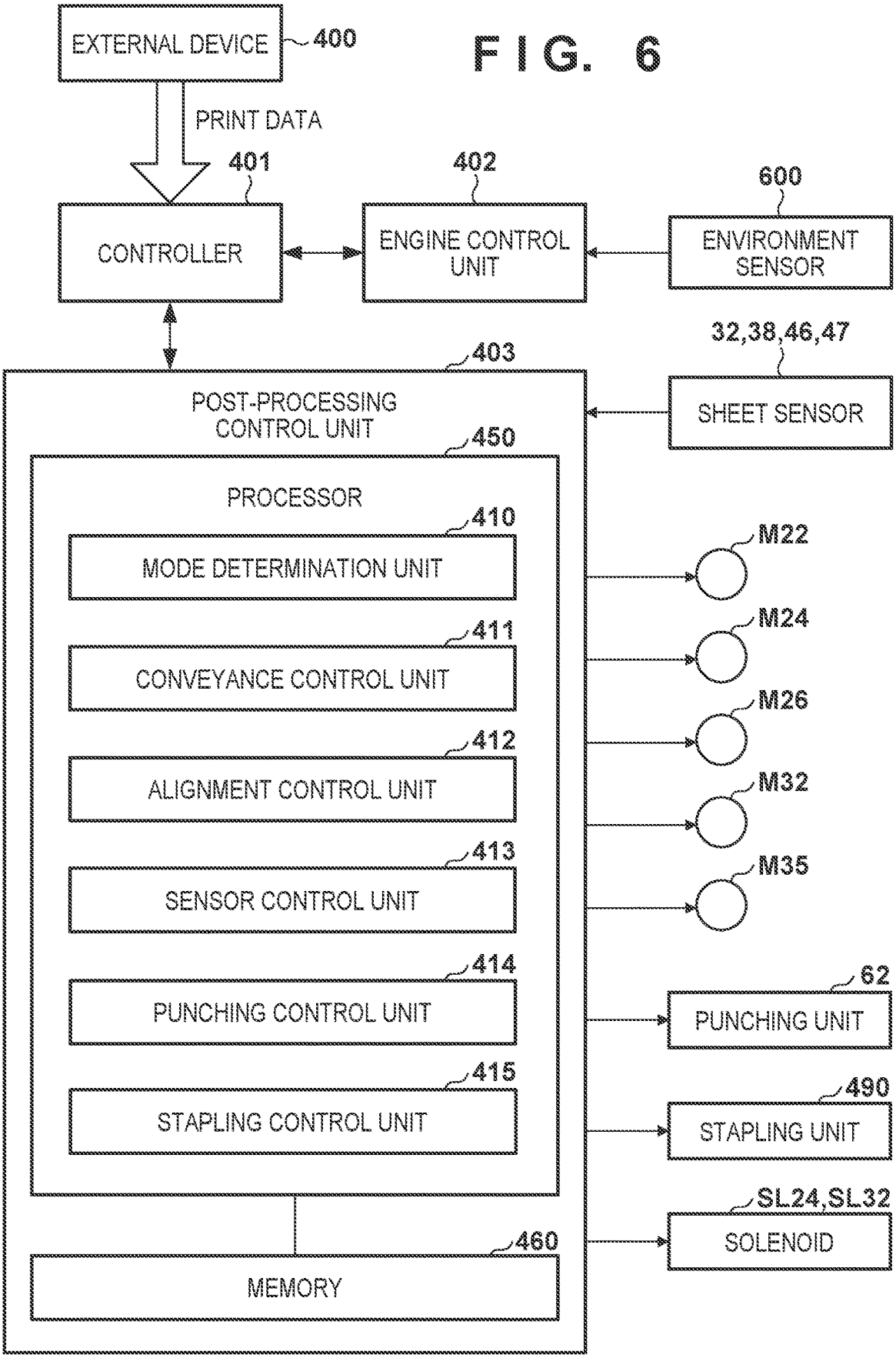
FIG. 6 is a block diagram for describing a control system.

FIG. 6 illustrates a control system according to embodiment 2. An environment sensor 600 that senses environment information (e.g., ambient temperature and ambient humidity) is connected to the engine control unit 402. The mode determination unit 410 makes a request for the environment information to the controller 401. Upon receiving the request, the controller 401 makes a request for the environment information to the engine control unit 402. Upon receiving the request, the engine control unit 402 acquires the environment information from the environment sensor 600, and returns the environment information to the controller 401. The controller 401 transmits the environment information to the processor 450 of the post-processing control unit 403. Thus, the mode determination unit 410 can acquire environment information of the environment in which the image forming system 100 or sheets P is/are placed. Note that a table or an arithmetic formula for determining the number M of sheets to be overlaid on one another while taking the environment information into consideration may be stored in the ROM area of the memory 460.

Figure 7:
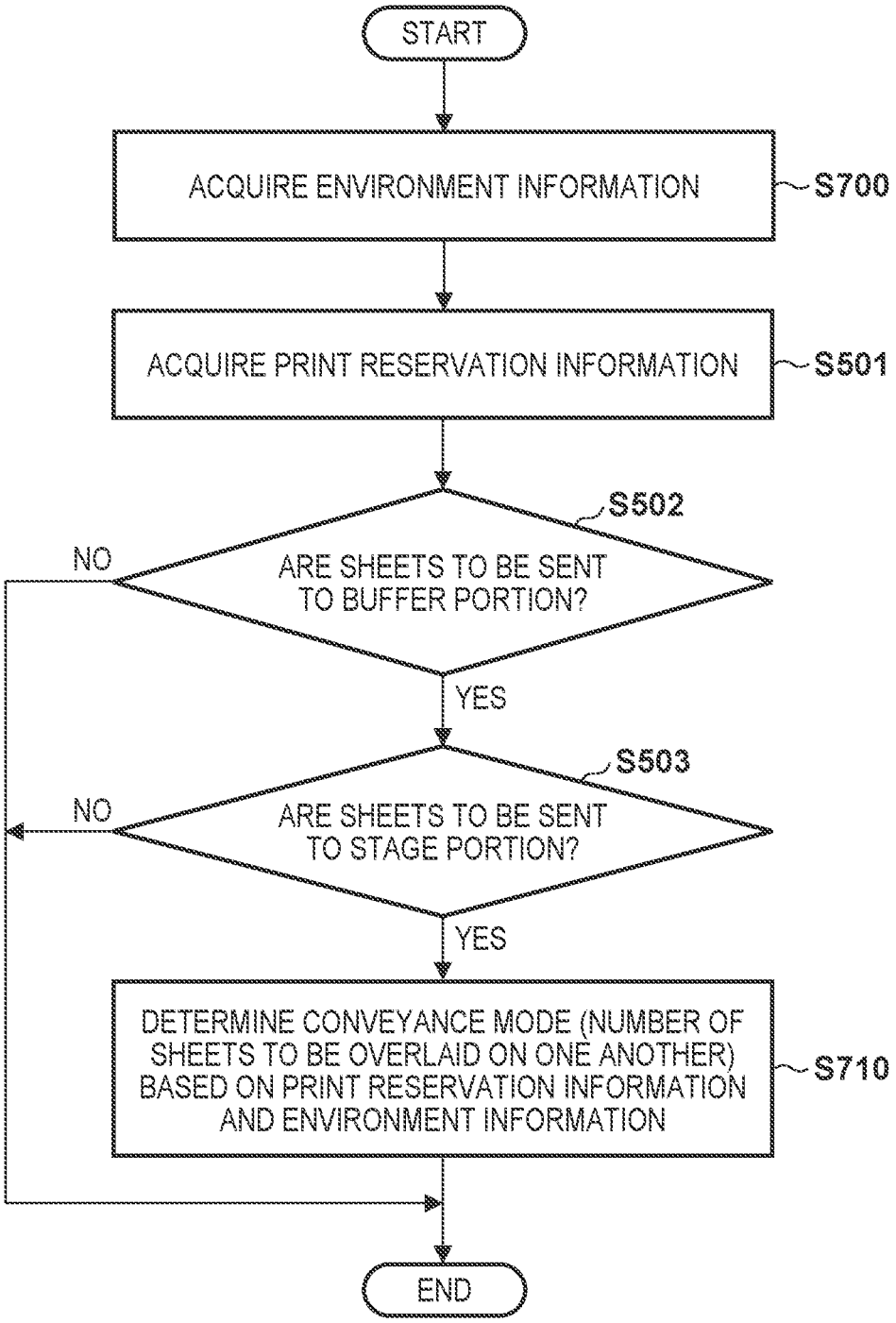
FIG. 7 is a flowchart illustrating a control method.

FIG. 7 illustrates a control method that the processor 450 executes in accordance with the control program. Note that the same reference symbols are provided to items in embodiment 2 that are the same as those in embodiment 1, and description thereof will be omitted.

In step S700, the processor 450 (mode determination unit 410) acquires the environment information (temperature and humidity information) from the environment sensor 600 installed in the image forming apparatus 1. Subsequently, the processor 450 executes steps S501 to S503. If sheets P are sheets to be sent to the stage portion 41, the processor 450 proceeds to step S710.

In step S710, the processor 450 (mode determination unit 410) determines the conveyance mode (the number of sheets to be overlaid on one another) based on the print reservation information and the environment information. For example, if the information about the type of the sheets P indicates gloss paper, the number M of sheets to be overlaid on one another is determined as 1. If the information about the type of the sheets P does not indicate thick paper, or in other words, if the information about the type of the sheets P indicates plain paper or thin paper, the number M of sheets to be overlaid on one another is determined as 2 or more. Note that, if the information about the type of the sheets P indicates thick paper, the mode determination unit 410 also takes the environment information into consideration. For example, if the image forming apparatus 1 is installed in a hot and humid environment, the number M of sheets to be overlaid on one another is determined as 1 because the frictional force Ffric_bottom would be excessively high. If the environment in which the image forming apparatus 1 is installed is not a hot and humid environment, the number M of sheets to be overlaid on one another is determined as 2 or more. Note that a table or an arithmetic formula that outputs the number M of sheets to be overlaid on one another when the ambient temperature and ambient humidity are input thereto may be used. Similarly, a table or an arithmetic formula that outputs the number M of sheets to be overlaid on one another when the ambient temperature, the ambient humidity, and the above-described parameter(s) are input thereto may be used.

Alignment accuracy can be maintained and jams can be suppressed at the same time to a further extent because environment information is taken into consideration in embodiment 2. While environment information is taken into consideration in addition to print reservation information in embodiment 2, this is merely one example. For example, the number M of sheets to be overlaid on one another may be determined as 1 for sheet types other than gloss paper. The number M of sheets to be overlaid on one another may be determined as 2 or more even for gloss paper. As described in embodiment 1, the parameters may include the size of sheets P, the image formation ratio, the area of image formation regions, the printed surface(s) (one side or both sides), etc.

While the environment sensor 600 is provided inside the image forming apparatus 1 in embodiment 2, this is merely one example. The environment sensor 600 may be connected inside the post-processing apparatus 4.

Technical Concept Derived from Embodiments

[Aspect 1]

As illustrated for example in FIG. 1, the first conveyance path R1 is one example of a first conveyance path that conveys a sheet P. The buffer portion 40 functions as a buffer unit (e.g., a sheet buffer) that receives the sheet P conveyed from the first conveyance path R1 and temporarily holds a predetermined number M of sheets so as to be overlaid on one another. The second conveyance path R2 is one example of a second conveyance path that conveys the predetermined number M of sheets P from the buffer unit when the temporary holding by the buffer unit is terminated. The stage portion 41 is one example of a stacking unit (e.g., a sheet tray) that stacks the predetermined number M of sheets P conveyed toward a first direction from the second conveyance path R2. The longitudinal alignment roller 32 functions as a moving unit (e.g., a contact member or a friction member) that comes into contact with the uppermost sheet P among the predetermined number M of sheets P stacked on the stacking unit and moves the uppermost sheet P further toward the first direction. The longitudinal alignment reference plate 33 is one example of a regulating unit (e.g., a regulation plate) that is provided downstream of the moving unit in the first direction and that comes into contact with an end portion of the stack of sheets on the stacking unit to regulate the position of the stack of sheets, the end portion of the stack of sheets being an end portion on the downstream side in the first direction. The post-processing control unit 403 functions as a control unit that controls the predetermined number M of sheets, the predetermined number M of sheets being the number of sheets that are to be temporarily accumulated in the buffer unit and conveyed to the stacking unit together. The post-processing control unit 403 (e.g., a controller, a CPU, or a processing circuit) determines the predetermined number M of sheets based on one or more physical parameters that affect a frictional force generated on the surface of the sheet P. Thus, sheet stack alignment accuracy can be maintained and jams can be suppressed at the same time.

[Aspect 2]

Upon determining that the predetermined number M of sheets is two or more sheets, the post-processing control unit 403 may generate a stack of sheets by overlaying two or more sheets P on one another in the buffer unit, and may convey the stack of sheets to the stacking unit via the second conveyance path R2. This may be referred to as a stack conveyance mode. On the other hand, upon determining that the predetermined number M of sheets is one sheet, the post-processing control unit 403 may temporarily hold one sheet in the buffer unit, and may convey the one sheet to the stacking unit via the second conveyance path R2. When a stack of sheets is conveyed to the stacking unit as described above, alignment accuracy may decrease or a jam may occur. In such cases, the predetermined number M of sheets is determined as 1, and sheets P are conveyed to the stacking unit one by one.

[Aspects 3 to 6]

The moving unit may be a rotating body that comes into contact with the uppermost sheet and rotates. The rotating body may be a belt or a roller. The rotating body may be a paddle. The moving unit may be a friction member that comes into contact with the uppermost sheet and moves linearly. For example, a friction member (e.g., a pad) that is moved linearly by a solenoid once the friction member comes into contact with the sheet P may be adopted. In such a manner, any member that moves the sheet P by utilizing the friction between the sheet P and itself can be adopted. Note that the conveyance force Ffeed generated by the moving unit is affected by the frictional force acting between the moving unit and the surface of the sheet P.

[Aspect 7]

The stapling unit 490 is one example of a post-processing unit that executes post-processing on a stack of sheets formed from N sheets stacked on the stacking unit. Here, the N sheets are more than or equal to the predetermined number of sheets. While an example in which N=5 is illustrated in FIGS. 3A to 3E, it suffices that N is no less than M.

[Aspect 8]

The stack discharge guide 34 is one example of a discharging unit that discharges a stack of sheets formed from N sheets stacked on the stacking unit toward a second direction that is opposite the first direction.

[Aspect 9]

The predetermined number M of sheets may be two or more sheets. As illustrated for example in FIG. 2E, etc., a preceding sheet arriving at the buffer unit earlier and a subsequent sheet arriving at the buffer unit later may be overlaid on one another in an offset state such that an end portion of the preceding sheet is closer to the stacking unit than an end portion of the subsequent sheet is. Accordingly, as illustrated in FIG. 3A, a plurality of sheets P forming a stack of sheets are aligned by coming into contact with the longitudinal alignment roller 32 in order from the lower ones of the sheets P. That is, it can be expected that alignment accuracy will be improved to a further extent.

[Aspect 10]

The pre-buffering rollers 22, the reversing rollers 24, and the internal discharge rollers 26 function as a switchback unit that sends the preceding sheet into the buffer unit from the first conveyance path R1, and draws the preceding sheet into the second conveyance path R2 from the buffer unit. The switchback unit stops conveying the preceding sheet after drawing the preceding sheet into the second conveyance path R2 from the buffer unit. Furthermore, once the subsequent sheet arrives from the first conveyance path R1, the switchback unit overlays the preceding sheet and the subsequent sheet on one another by sending the subsequent sheet and the preceding sheet into the buffer unit.

[Aspects 11 and 12]

The physical parameters may include environment information of the environment surrounding the sheet or the environment surrounding the post-processing apparatus. The environment information may include at least one of the temperature and humidity of the surrounding environment. This is because temperature and humidity are parameters affecting the frictional force of the sheet P.

[Aspect 13]

The physical parameters may include information about the surface property of the sheet P or a treatment applied to the surface of the sheet. Examples of such a treatment include a glossing treatment and a coating treatment.

[Aspects 14 and 15]

The physical parameters may include information about images printed on the sheet P. The information about images may be an image formation ratio, which is a proportion of the surface area of the sheet P occupied by images, or the area of image formation regions on the sheet P.

[Aspect 16]

The information about images printed on the sheet P may include information indicating a state in which images have been formed on only one side of the sheet P, a state in which images have been formed on both sides of the sheets P, or a state in which images have not been formed on either side of the sheet P. If images have not been formed on either side of the sheet P, the sheet P may be inserted to a sheet stack as a slip sheet (insertion sheet).

[Aspects 17 and 18]

The physical parameters may include a fixing temperature of the sheet. The physical parameters may include a conveyance speed of the sheet. These parameters also affect the frictional force of the sheet P.

[Aspect 19]

The control unit (e.g., the processor 450) may determine the predetermined number M of sheets based on the type of the sheet P. Type information indicating the type of the sheet P may be a grammage, a brand (product name or product identification information), or the like.

[Aspect 20]

The memory 460 may function as a storage unit for storing jam occurrence ratios for individual types of sheets P. The processor 450 may reduce the predetermined number M of sheets for sheet types for which the jam occurrence ratio is high, and increase the predetermined number M of sheets for sheet types for which the jam occurrence ratio is low.

[Aspect 21]

The memory 460 may function as a storage unit for storing, for individual sheet types, occurrence ratios of a regulation failure (alignment failure) by the regulating unit. The processor 450 may reduce the predetermined number M of sheets for sheet types for which the regulation failure occurrence ratio is high, and increase the predetermined number M of sheets for sheet types for which the regulation failure occurrence ratio is low.

[Aspect 22]

The image forming system 100 includes the image forming apparatus 1 forming images on sheets P, and the post-processing apparatus 4 applying post-processing to the sheets P output from the image forming apparatus 1. The post-processing apparatus 4 is the post-processing apparatus 4 according to any one of aspects 1 to 18.

OTHER EMBODIMENTS

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2022-040735, filed Mar. 15, 2022 which is hereby incorporated by reference herein in its entirety.

What is claimed is:

1. A post-processing apparatus comprising:

a first conveyance path along which a sheet is conveyed;

a buffer unit that receives the sheet conveyed from the first conveyance path and temporarily holds a predetermined number of sheets so as to be overlaid on one another;

a second conveyance path along which the predetermined number of sheets from the buffer unit are conveyed when the temporary holding by the buffer unit is terminated;

a stacking unit that stacks the predetermined number of sheets conveyed toward a first direction from the second conveyance path;

a moving unit that comes into contact with the uppermost sheet among the predetermined number of sheets stacked on the stacking unit and moves the uppermost sheet further toward the first direction;

a regulating unit that is provided downstream of the moving unit in the first direction and that comes into contact with an end portion of the stack of sheets on the stacking unit to regulate the position of the stack of sheets, the end portion of the stack of sheets being an end portion on the downstream side in the first direction; and a control unit that controls the predetermined number of sheets, the predetermined number of sheets being the number of sheets that are to be temporarily accumulated in the buffer unit and conveyed to the stacking unit together, wherein the control unit determines the predetermined number of sheets based on one or more physical parameters that affect a frictional force generated on the surface of the sheet.

2. The post-processing apparatus according to claim 1, wherein the control unit is configured to cause the post-processing apparatus to:

upon determining that the predetermined number of sheets is two or more sheets, generate a stack of sheets by overlaying the two or more sheets on one another in the buffer unit, and convey the stack of sheets to the stacking unit via the second conveyance path; and, upon determining that the predetermined number of sheets is one sheet, temporarily hold the one sheet in the buffer unit, and convey the one sheet to the stacking unit via the second conveyance path.

3. The post-processing apparatus according to claim 1, wherein the moving unit includes a rotating body that comes into contact with the uppermost sheet and rotates.

4. The post-processing apparatus according to claim 3, wherein the rotating body includes a roller.

5. The post-processing apparatus according to claim 3, wherein the rotating body includes a paddle.

6. The post-processing apparatus according to claim 1, wherein the moving unit includes a friction member that comes into contact with the uppermost sheet and moves linearly.

7. The post-processing apparatus according to claim 1, further comprising a post-processing unit that executes post-processing on a stack of sheets formed from N sheets stacked on the stacking unit, wherein the N sheets are more than or equal to the predetermined number of sheets.

8. The post-processing apparatus according to claim 1, further comprising a discharging unit that discharges a stack of sheets formed from N sheets stacked on the stacking unit toward a second direction that is opposite the first direction.

9. The post-processing apparatus according to claim 1, wherein if the predetermined number of sheets is two or more sheets, a preceding sheet arriving at the buffer unit earlier and a subsequent sheet arriving at the buffer unit later are overlaid on one another in an offset state such that a distance between an end portion of the preceding sheet and the stacking unit is shorter than a distance between an end portion of the subsequent sheet and the stacking unit.

10. The post-processing apparatus according to claim 9, further comprising a switchback unit that sends the preceding sheet into the buffer unit from the first conveyance path, and draws the preceding sheet into the second conveyance path from the buffer unit, wherein the switchback unit stops conveying the preceding sheet after drawing the preceding sheet into the second conveyance path from the buffer unit, and, once the subsequent sheet arrives from the first conveyance path, the switchback unit overlays the preceding sheet and the subsequent sheet on one another by sending the subsequent sheet and the preceding sheet into the buffer unit.

11. The post-processing apparatus according to claim 1, wherein the physical parameters include environment information of the environment surrounding the sheet or the environment surrounding the post-processing apparatus.

12. The post-processing apparatus according to claim 11, wherein the environment information includes at least one of the temperature and humidity of the surrounding environment.

13. The post-processing apparatus according to claim 11, wherein the physical parameters include information about the surface property of the sheet or a treatment applied to the surface of the sheet.

14. The post-processing apparatus according to claim 11, wherein the physical parameters include information about images printed on the sheet.

15. The post-processing apparatus according to claim 11, wherein the information about images printed on the sheet includes an image formation ratio, which is a proportion of the surface area of the sheet occupied by images, or the area of image formation regions on the sheet.

16. The post-processing apparatus according to claim 15, wherein the information about images printed on the sheet includes information indicating a state in which images have been formed on only one side of the sheet, a state in which images have been formed on both sides of the sheet, or a state in which images have not been formed on either side of the sheet.

17. The post-processing apparatus according to claim 11, wherein the physical parameters include a fixing temperature of the sheet.

18. The post-processing apparatus according to claim 11, wherein the physical parameters include a conveyance speed of the sheet.

19. An image forming system comprising:

an image forming apparatus that forms images on sheets; and a post-processing apparatus that applies post-processing to the sheets output from the image forming apparatus, wherein the post-processing apparatus comprises:

a first conveyance path along which a sheet is conveyed;

a buffer unit that receives the sheet conveyed from the first conveyance path and temporarily holds a predetermined number of sheets so as to be overlaid on one another;

a second conveyance path along which the predetermined number of sheets from the buffer unit are conveyed when the temporary holding by the buffer unit is terminated;

a stacking unit that stacks the predetermined number of sheets conveyed toward a first direction from the second conveyance path;

a moving unit that comes into contact with the uppermost sheet among the predetermined number of sheets stacked on the stacking unit and moves the uppermost sheet further toward the first direction;

a regulating unit that is provided downstream of the moving unit in the first direction and that comes into contact with an end portion of the stack of sheets on the stacking unit to regulate the position of the stack of sheets, the end portion of the stack of sheets being an end portion on the downstream side in the first direction; and a control unit that controls the predetermined number of sheets, the predetermined number of sheets being the number of sheets that are to be temporarily accumulated in the buffer unit and conveyed to the stacking unit together, wherein the control unit determines the predetermined number of sheets based on one or more physical parameters that affect a frictional force generated on the surface of the sheet.

* * * * *